United States Patent [19]

Thompson

[11] Patent Number: 4,565,083

[45] Date of Patent: Jan. 21, 1986

[54] STRAIGHTENING ROLLS

[75] Inventor: E. Gordon Thompson, State College, Pa.

[73] Assignee: Sutton Engineering Company, Pittsburgh, Pa.

[21] Appl. No.: 484,914

[22] Filed: Apr. 14, 1983

[51] Int. Cl.[4] ..... B21D 3/04

[52] U.S. Cl. ..... 72/98; 72/99

[58] Field of Search ..... 72/98, 99, 100

[56] References Cited

U.S. PATENT DOCUMENTS

| | | | |
|---|---|---|---|
| 1,649,204 | 11/1927 | Wise . | |
| 2,655,194 | 10/1953 | Nilsson | 72/98 |
| 4,056,958 | 11/1977 | Fangmeier et al. | 72/99 |
| 4,176,537 | 12/1979 | Brown | 72/99 |
| 4,494,394 | 1/1985 | Nilsson | 72/98 |

FOREIGN PATENT DOCUMENTS

| | | | |
|---|---|---|---|
| 561587 | 6/1977 | U.S.S.R. | 72/99 |

*Primary Examiner*—Lowell A. Larson

*Attorney, Agent, or Firm*—Carothers & Carothers

[57] ABSTRACT

A roll configuration for use in a roll type straightener including a concave surface of revolution formed on a roll for line contact of the roll with a cylindrical workpiece wherein the throat of the surface of revolution is offset longitudinally from the axial midpoint of the surface of revolution whereby a pair of such rolls may be employed in mutually-aligned or non-offset relationship with respect to the cylindrical workpiece axis to provide lateral restraint of such a workpiece being subjected to a bending moment.

8 Claims, 7 Drawing Figures

STRAIGHTENING ROLLS

BACKGROUND OF THE INVENTION

In the art of roll type straighteners, it is well known to employ a straightener apparatus having combinations of contoured rolls for the purpose of straightening lengths of metal stock of circular cross section, for example, steel rods or pipe. Such straightening apparatus has often comprised, for example, a five-roll arrangement, in which a pair of contoured support rolls are positioned, respectively above and below the workpiece with their axes skewed to one another in parallel planes and in addition skewed to the axis of the workpiece being supported thereby. A second pair of similarly disposed support rolls is spaced from this first-mentioned pair of rolls along the axis of the workpiece being supported thereby, and an unopposed contoured pressure roll is disposed intermediate the two pairs of support rolls to engage the workpiece and, in conjunction with the support rolls, to apply a bending moment thereto. Another such machine has a six-roll cofiguration similar to that described above, but in which a pair of opposed pressure rolls is located intermediate the two pairs of support rolls.

Typically, one of the rolls in each pair of support rolls is a driven roll, while the other is an idler. The work preferably engages each support roll in line contact along the length of the roll body whereby, as the driven rolls turn, the workpiece is rotated axially and advanced in the axial direction through the straightener in the well-known manner.

These and other configurations of roll straighteners have customarily utilized opposed pairs of axially spaced-apart support rolls to support the stock being worked, and suitable roll contour for the support roll pairs has long been a primary concern in the art. For example, U.S. Pat. No. 1,649,204 of Wise discloses a roll surface profile for the rolls of a straighener generally of the type specified above.

In a necessary function of the support roll pairs in a contoured roll straightener of the type described to provide lateral restraint for the workpiece in order that the bending movement applied to the workpiece will not tend to bend it in planes other than in the vertical plane of its own axis. In addition, in the absence of proper lateral restraint provided by the support roll pairs, the applied bending movement may cause the workpiece to progress through the straightener rolls along a path skewed from the proper path of travel. This may result in unnecessary marring of the workpiece surface, increased energy demands for a given straightening operation, and accelerated straightener roll wear.

In order to provide the requisite lateral restraint, various support roll pair configurations have been utilized. In general, the proper lateral restraint for a given roll pair, positioned in the usual manner above and below the workpiece, may be considered in terms of the angle with respect to vertical of the net restraining force applied by a support roll in cross-sectional planes generally perpendicular to the workpiece axis. The lateral restraining force is distributed along the line of contact between roll and workpiece, and acts perpendicularly to the mutual tangent therebetween.

The angle from vertical of the net restraining force is a function of roll diameter and the axial distance from the roll throat. That is, at the roll throat, the force applied by a support roll in a straightener of the type specified is vertically directed and provides no lateral component, but at successively greater distances from the roll throat along the line of contact with the workpiece, the angle with respect to vertical of the force applied by the support roll increases to a maximum angle adjacent the roll ends. Therefore, the lateral component of a constant supporting force would increase from zero at the roll throat to a maximum at the roll ends.

In order to provide proper lateral support for the workpiece, the rolls of each support roll pair must be so contoured and positioned with respect to one another that the resultant of the supporting forces applied thereby to the workpiece provide a lateral vector component to resist the lateral deflection tendency that would otherwise be inherent in the use of skewed, contoured rolls for workpiece support.

Various configurations of support roll pairs have been proposed in the prior art to provide the necessary lateral restraint. For example, one prior approach has been to utilize a pair of mutually-centered rolls of different diameters and length to provide workpiece support and the requisite lateral restraint. One shortcoming of this approach has been the need for manufacture of at least two distinct roll designs for each support roll pair. In addition, as the rolls of each such pair of of differing length, the required lateral restraint is provided only by so much of the lines of contact of each roll as are mutually coextensive or oveerlapping along the axial extent of the workpiece. The longer roll projects beyond the ends of the shorter roll and its engagement with the workpiece in these non-overlapping regions does not provide suitable lateral restraint for the workpiece. Indeed, it may contribute to undesirable lateral deflection of the workpiece.

Another prior approach has involved use of a roll pair in which the rolls are offset from one another, such that there is a displacement along the axis of the workpiece between the throats of the two rolls of each pair. This approach, like that described above, suffers in that the lateral restraint is provided only in the zone of overlap of the lines of contact of each roll with the workpiece. Accordingly, a significant portion of each such roll is ineffective for proper lateral restraint of the workpiece, and may be a cause of lateral deflection.

In the prior art, it has been considered desirable that the support rolls of a contoured roll straightener perform a rounding up operation on the stock passing therethrough, as this was one way in which to enhance product quality by taking advantage of an inherent capability of some configurations of support roll pairs. This has been possible in prior roll pairs only if the roll throats were centered with respect to each other. Accordingly, another shortcoming of prior offset roll pairs has been the loss of the beneficial rounding up capability.

SUMMARY OF THE INVENTION

The present invention contemplates an improved supporting roll pair for a contoured roll type straightener in which each of the rolls in a pair are of identical configuration, each including a relatively large diameter axial end, an opposite relatively smaller diameter axial end, and an intervening contoured cylindrical surface comprising a concave surface of revolution having an axis of revolution coincident with the roll axis. The throat of the concave roll surface is displaced axially from the longitudinal center of the roll whereby two such identical rolls, utilized as a support roll pair, may be positioned in mutually-coextending relationship with the roll throats longitudinally offset from one another.

The rolls of the present invention provide for lateral restraint of the workpiece throughout substantially the entire length of each roll. In addition, the beneficial rounding up capability of the rolls is retained, whereas in prior two roll supports, it was not possible to provide a rounding up capability and completely sufficient lateral restraint, as these were considered to be dependent upon mutually exclusive design criteria involving the relative positioning of the roll throats with respect to one another.

It is therefore one object of the present invention to provide an improved roll for a roll type straightener.

Another object of the present invention is to provide a roll for a roll type straightener in which the roll throat is displaced axially from the longitudinal center of the roll.

Yet another object of the present invention is to provide an improved two roll support having identical aligned rolls.

Still another object of the present invention is to provide a two roll support for a roll straightener wherein the lines of contact of the two rolls of the support are generally coextensive along the axial extent of the workpiece being supported thereby, and the locations of the respective roll throats on the lines of contact are axially displaced from one another.

Other objects and advantages appear in the following description and claims.

The accompanying drawings shown, for the purpose of exemplification without limiting the invention or the claims thereto, certain practical embodiments illustrating the principles of this invention wherein:

Figure 2:
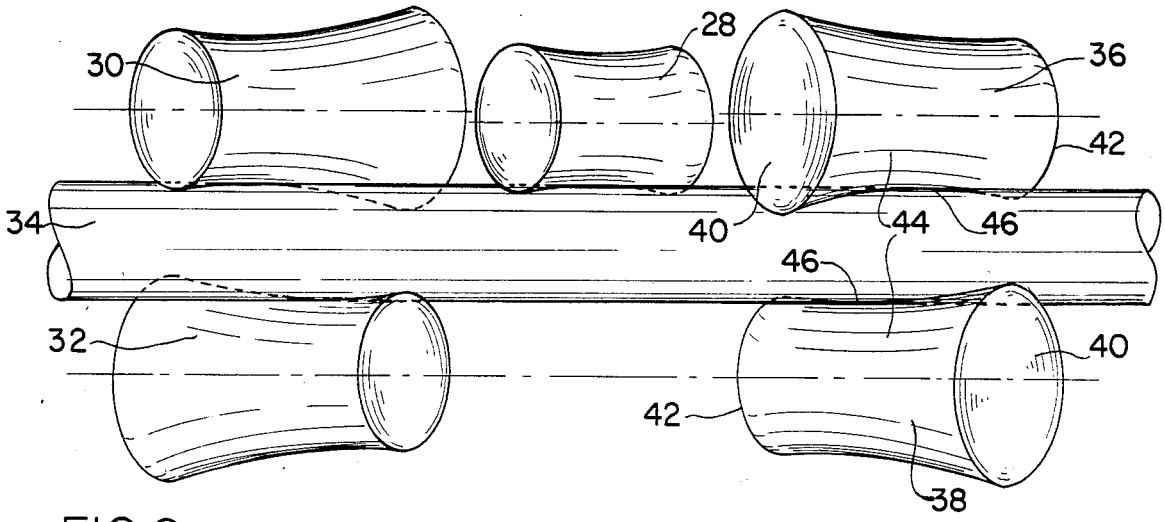
FIG. 2 is a generally schematic elevation of support roll sets according to a preferred embodiment of the present invention.
Figure 3:
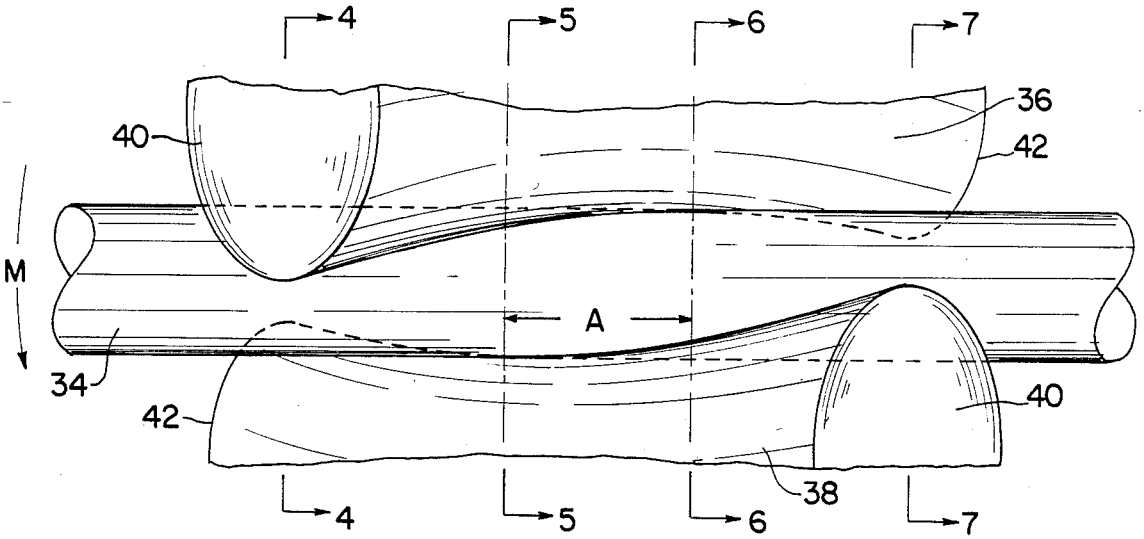

FIG. 3 is a partial elevation of one two roll support set from FIG. 2; and FIGS. 4, 5, 6 and 7 are partial cross-sections taken on lines 4—4, 5—5, 6—6 and 7—7 respectively, of FIG. 3.

Figure 1:
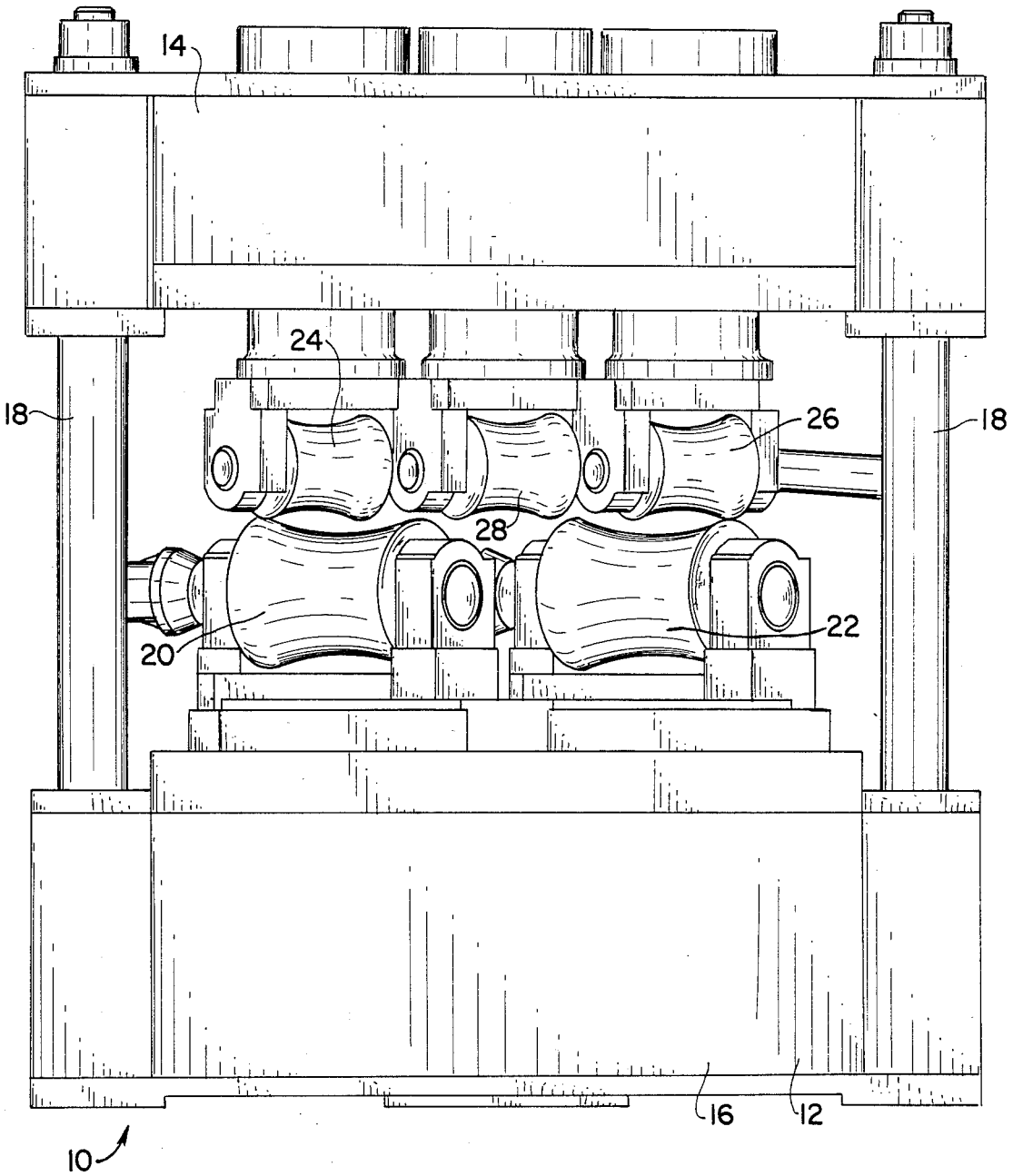
FIG. 1 is an elevation of a five roll straightener including conventional support roll sets.

There is generally indicated at 10 in FIG. 1, a roll type straightener of the well known type which includes a frame 12 having upper and lower frame portions 14 and 16, respectively, which are secured together by a plurality of rods 18 extending therebetween. The lower frame portion 16 supports a pair of laterally spaced workpiece support rolls 20 and 22, while the upper frame portion 14 supports a respective pair of cooperating support rolls 24 and 26 in overlying juxtaposition, respectively, with rolls 20 and 22. The support roll pairs 20 and 24, and 22 and 26 thus provided are laterally spaced apart along the path of travel of an elongated cylindrical workpiece (not shown), such that the workpiece is supported at axially spaced locations as it is processed through the straightener.

Intermediate the spaced apart support roll pairs 20 and 24, and 22 and 26, there is disposed an unopposed pressure roll 28 supported by upper frame portion 14. Pressure roll 28 is operative in conjunction with the laterally spaced support roll pairs 20 and 24, and 22 and 26, to apply a bending moment to the workpiece as it is fed through the straighener. An additional pressure roll (not shown) to oppose roll 28 may be included in straightener 10.

As shown, the axes of rotation of rolls 24 and 26 are skewed in parallel planes with respect to the respective axes of rotation of rolls 20 and 22. In addition, the axes of rotation of all of the rolls 20, 22, 24, 26 and 28 are skewed to the axis of the workpiece in the known manner. Accordingly, the workpiece is frictionally engaged by support roll pairs 20 and 24, and 22 and 26, and as a power driven roll in each support roll pair is rotated, the workpiece is rotated axially and is advanced axially through the straightener as is well known. Preferably, rolls 20, 22, 24, 26 and 28 are adjustable in both separation between individual rolls of the support roll pairs, and in angle of skew with respect to the workpiece axis whereby the straightener is adapted to process tubular or other circular cross section stock over a range of stock diameters.

Inasmuch as the elements hereinabove described are completely conventional and are well known to those versed in the art, further detailed description thereof is not believed necessary, except as may be otherwise required to completely describe the present invention.

Referring now to FIG. 2, there is shown an arrangement of straightener rolls similar in layout to that of FIG. 1, but incorporating support roll pairs of the present invention. The rolls of FIG. 2 include a left end pair of support rolls 30 and 32, shown engaging an elongated cylindrical workpiece 34. Spaced laterally from support roll pair 30 and 32, is a second pair of support rolls 36 and 38, which also engage workpiece 34. Intermediate the support roll pairs 30 and 32, and 36 and 38, there is an unopposed pressure roll 28, which may be similar in all salient respects to the pressure roll 28 of FIG. 1. In lieu of pressure roll 28, a pair of opposed pressure rolls may be employed.

It will be seen that the rolls in each support roll pair 30 and 32, and 36 and 38 of FIG. 2 preferably are identical, each having a relatively enlarged diameter axial end 40, a relatively smaller diameter opposite axial end 42, and an intermediate contoured cylindrical surface 44 comprised in axial profile of an axially extending concavity. The roll surface 44 is a correspondingly contoured surface of revolution having its axis of revolution coincident with the rotary axis of the roll. The concavity of roll surface 44 reaches its maximum depth or throat at 46, which will be seen to be offset longitudinally from the axial midpoint between the roll ends 40 and 42. Accordingly, as shown in FIG. 2, the two rolls of each support roll pair 30 and 32, and 36 and 38, are identical, but one roll (e.g. roll 36) is reversed with respect to the other (e.g. roll 38), such that the enlarged diameter axial end 40 of each such roll is juxtaposed with the relatively smaller diameter axial end 42 of the other such roll. The lines of contact of each roll 36 and 38 with workpiece 34 are mutually coextensive substantially throughout the length of the surface 44 of rolls 36 and 38, whereby both rolls of each roll pair are effective for support of workpiece 34 substantially throughout the length of surface 44. Because rolls 36 and 38 are identical and reversed as described, the offset throats 46 thereof are displaced from one another in opposite directions from the aligned axial midpoint of the juxtaposed rolls.

Contoured rolls such as rolls 30, 32, 36 and 38, may be produced by grinding of rotating blanks by an elongated cylindrical rotary grinder skewed to the axis of rotation of the rotating blank in a plane parallel thereto to duplicate the skewed orientation with respect to the roll axis of a workpiece having the diameter of the cylindrical grinder. When viewed from a direction perpendicular to the parallel planes of the roll blank and grinder axis, the point of intersection of these axes defines the axial location on the roll of the finished roll throat. In practice, a roll so produced will be suitable for use to support workpieces having a range of diameters including the grinder diameter. Adjustment of roll skew angle with respect to the workpiece allows such use of a single roll design for a range of workpiece diameters.

Referring now to FIG. 3, and to related FIGS. 4 through 7 inclusive, the manner of workpiece support provided by support roll pair 36 and 38 will be perceived. As a guide to design, exemplary dimensions of rolls 36 and 38 are included hereinbelow, it being understood that such exemplary dimensions are not to be considered as limitations on the invention. All given exemplary dimensions are based upon a workpiece of three inch diameter and a skew angle between the workpiece axis and the roll axis of 32½ degrees. For these conditions, rolls 36 and 38 preferably have enlarged diameter ends 40 of 18.380 inches diameter and smaller diameter ends 42 of 15.210 inches diameter. The throat of each roll 36 and 38 is positioned 5.625 inches axially from the plane of smaller diameter end 42, and 10.625 inches axially from the plane of enlarged diameter end 40. Accordingly, when rolls 36 and 38 are reversed and juxtaposed with respect to one another as described, there is provided an axial offset A between the roll throat centers which, for the given exemplary dimensions, is five inches.

FIGS. 4 through 7 indicate the manner in which rolls 36 and 38 provide lateral restraint for workpiece 34 substantially throughout the length of each surface 44 coextending with workpiece 34. The support provided by roll pair 30 and 32 may be considered similar in all salient respects. In FIG. 3, and for FIGS. 4 through 7 combined, M indicates the bending moment applied by pressure roll 28. It will be seen from FIGS. 4 through 7 that in any given cross sectional plane, the support forces exerted by roll 36 and 38 in response to the applied bending moment M act in the direction perpendicular to the common tangent of the roll and the workpiece, which common tangent intersects the line of contact between roll and workpiece. Accordingly, to provide suitable support including sufficient lateral restraint in any given cross-sectional plane, the net restraining force of rolls 36 and 38 in that plane must include a component to oppose any tendency of workpiece 34 to be displaced laterally on the roll surface under the impetus of bending moment M.

Figures 4, 5, 6, 7:
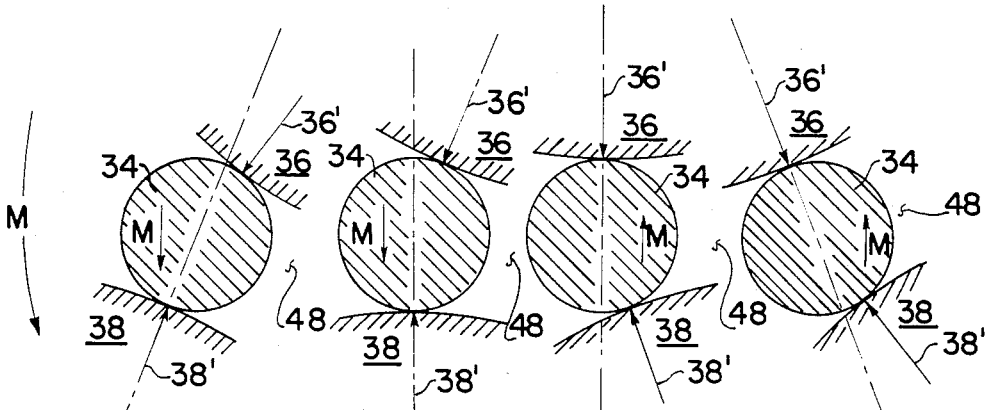

For example, in FIG. 4, it will be seen that bending moment M exerted on workpiece 34 will tend to displace workpiece 34 downwardly to the right over the surface of roll 38. The restraining force 38′ of roll 38 alone provides no opposing force component directed upwardly to the left; however, together with restraining force 36′ of roll 36, a suitable leftward restraining force component acting upwardly to the left is provided by rolls 36 and 38 together to preclude any lateral displacement of workpiece 34 under impetus of the bending moment M. Another view of the lateral restraining capability of rolls 36 and 38 at plane 4—4 (FIG. 4) is that the gap 48 between rolls 36 and 38, located downwardly and to the right of workpiece 34, narrows to a width less than the workpiece diameter whereby any vector force component of bending moment M which would tend to displace workpiece 34 laterally into the narrowed gap 48 will be resisted by an equal and opposite vector force which is a component of the resultant of force 38′ and 36′.

In FIG. 5, the cross-sectional plane 5—5 is coincident with the throat of roll 38, and the restraining force 38′ is therefore directed vertically upward. The component 36′, however, is directed downwardly to the left, whereby the resultant of 36′ and 38′ again provides a vector component to restrain against workpiece 34 sliding downward to the right under the impetus of bending moment M.

In FIG. 6, the cross-sectional plane 6—6 is coincident with the throat of roll 36, whereby vector force 36′ is directed vertically downward, and force 38′ is directed upwardly to the left. As rolls 36 and 38 are identical and are reversed and juxtaposed with respect to each other, the restraining force pattern at plane 6—6 is similar in all respects to that in plane 5—5. Likewise, the restraining force pattern in plane 7—7 is similar in all respects to that in plane 4—4, previously described. At the aligned longitudinal midpoints of rolls 36 and 38, the bending movement M changes from downwardly directed to upwardly directed, and therefore the restraining forces effective to one longitudinal side of the aligned roll midpoints are reversed from those effective on the other longitudinal side of the aligned roll midpoints.

In all cross-sectional planes throughout the mutually coextending lengths of surface portions 44 of rolls 36 and 38, the bending moment M is tending to move workpiece 34 into the gap 48. As the contours of rolls 36 and 38 in each such cross-sectional plane define a gap 48 which is narrower than the diameter of workpiece 34, such lateral displacement of workpiece 34 is resisted by contact thereof with the roll surfaces on the respective lines of contact therebetween. As a result, the workpiece follows a straight and true path of travel over roll pairs 30 and 32, and 36 and 38. The absence of undesirable lateral deviation from such path provides for a more reliable and predictable straightening operation.

An additional benefit of the described support roll pairs is that in those regions of workpiece contact where the diameter of one roll is significantly greater than the diameter of the other, the tangential velocity of the larger diameter roll exceeds that of the smaller diameter roll, as the rolls are rotating at a uniform r.p.m. This higher tangential velocity is directed away from the narrowing gap 48 whereby the contact of the higher tangential velocity roll with the workpiece tends to urge the workpiece away from the gap 48 rather than into it. For example, in FIG. 4, roll 36 is rotating in the clockwise direction, and at this plane is the larger diameter roll. Therefore, as between rolls 36 and 38, roll 36 has the larger tangential velocity and is tending to urge workpiee 34 away from gap 48.

According to the description hereinabove, there is provided by the present invention an improved roll type straightener utilizing an improved roll configuration which, when used in support roll pairs, provides effective lateral restraint for a workpiece being supported thereby. The improved roll configuration permits use of identical rolls in each support roll pair and in addition permits the identical rolls to be aligned with one another such that their lines of contact with the workpiece are mutually axially coextensive thereon.

Notwithstanding the description hereinabove of a specific preferred embodiment of the invention, it is to be appreciated that the invention is susceptible to various alternative embodiments with numerous modifications thereto without departing from the broad spirit and scope thereof. For example, the specific given dimensions of the rolls may be varied with a latitude of design criteria; the proportionate longitudinal offset of the roll throats with respect to the overall roll length may be likewise varied; the lines of contact of the roll pairs with the workpiece need not necessarily be coextensive along the axial extent of the workpiece to provide suitable lateral restraint throughout axially overlapping extents of the lines of contact. Thus, identical rolls configured generally in accordance with the above description may be utilized even though not positioned such that their lines of contact with the workpiece are mutually coextensive. For example, dimension A in FIG. 3 might be reduced by offsetting roll 36 to the left with respect to roll 38 to a limited degree without adversely affecting the desirable lateral restraint provided by the roll pair 36 and 38 in their overlapping extends. In addition, it will be appreciated that the extent of surface 44 axially of the roll body need not necessarily coincide with the overall length of the roll, but may alternatively be shorter than the overall length of the roll body. Furthermore, it will be appreciated that only selected arrangements of support roll pairs and pressure rolls may be employed. For example, in the roll configuration of FIG. 2, it is not possible to achieve the desired lateral support if the positions of rolls 36 and 38 are interchanged by turning the roll pair 180 degrees about the workpiece axis.

These and other embodiments and modifications having been envisioned and anticipated by the inventor, the invention is intended to be construed as broadly as permitted by the scope of the claims appended hereto.

I claim:

1. In a roll type straightener for straightening an elongated cylindrical workpiece wherein spaced support means are provided for supporting the workpiece at axially spaced locations for advancing the workpiece axially through the straightener while a transverse load is applied to the workpiece by a deforming means axially intermediate the support means, each said support means comprising:

a pair of rotary support rolls each adapted to engage such a workpiece to support such a transverse load; each of said rolls including a generally concave surface of revolution which is adapted to engage such a cylindrical workpiece in line contact therewith throughout a given axial extent of the workpiece and which includes a minimum diameter throat portion that is offset axially from the axial midpoint of said surface of revolution; and said rolls being located with respect to each other such that the lines of contact thereof with such a workpiece are substantially mutually coextensive with respect to the axial extent of such workpiece and the respective said throat portions of said rolls are offset from each other along the axial extent of such workpiece.

2. The support as claimed in claim 1, wherein said surfaces of revolution are adapted to engage such a cylindrical workpiece in line contact therewith substantially throughout the axial length of the respective said surface of revolution.

3. The support as claimed in claim 2, wherein said surfaces of revolution extend substantially throughout the axial extent of the respective said rolls.

4. The support as claimed in claim 3, wherein each said minimum diameter throat portion is offset axially from the longitudinal midpoint of the respective said roll.

5. The support as claimed in claim 4, wherein each said roll is asymetrical with respect to the diametrical plane of the respective said minimum diameter throat portion.

6. The support as claimed in claim 5, wherein said rolls are substantially identical.

7. A roll type straightener for straightening elongated cylindrical members, said straightener comprising:

a rigid frame;

at least a pair of laterally spaced, power driven support means for supporting such a cylindrical member for axial rotation and advancement thereof through said straightener;

a pressure means located laterally intermediate said pair of support means and adapted to apply a bending moment to such a supported cylindrical member;

at least one of said pair of support means including a pair of juxtaposed, formed supporting rolls;

said supporting rolls including formed, generally concave, axially elongated surfaces of revolution by which said supporting rolls are adapted to engage such a cylindrical member along respective lines of contact which extend throughout substantially the entire axial length of the respective surfaces of revolution;

each of said supporting rolls including a minimum diameter throat portion which is axially offset from the axial midpoint of the respective said surface of revolution; and said pair of supporting rolls being positioned with respect to each other such that the respective said lines of contact with such a cylindrical member are mutually coextensive with a given axial extent of such cylindrical member and the respective said minimum diameter throat portions are offset from each other along the axial extent of such cylindrical member.

8. The straightener as claimed in claim 8, wherein said at least one of said pair of support means is both of said support means.

* * * * *